US007107969B2

(12) United States Patent
Norcutt et al.

(10) Patent No.: US 7,107,969 B2
(45) Date of Patent: Sep. 19, 2006

(54) TWIST-LOCK FUEL INJECTOR ASSEMBLY

(75) Inventors: John Norcutt, Whitmore Lake, MI (US); John Kilby, New Boston, MI (US); Kevin Fulmer, Middlebury, IN (US)

(73) Assignee: Ford Global Technologies, LLC, Dearborn, MI (US)

( * ) Notice: Subject to any disclaimer, the term of this patent is extended or adjusted under 35 U.S.C. 154(b) by 115 days.

(21) Appl. No.: 10/711,616

(22) Filed: Sep. 28, 2004

(65) Prior Publication Data

US 2006/0065244 A1 Mar. 30, 2006

(51) Int. Cl.
*F02M 37/04* (2006.01)

(52) U.S. Cl. ..... 123/470

(58) Field of Classification Search ..... 123/456, 123/468, 469, 470

See application file for complete search history.

(56) References Cited

U.S. PATENT DOCUMENTS

| | | | | |
|---|---|---|---|---|
| 4,295,452 | A * | 10/1981 | Lembke et al. | 123/470 |
| 5,038,738 | A | 8/1991 | Hafner et al. | |
| 5,209,204 | A | 5/1993 | Bodenhausen et al. | |
| 5,718,205 | A * | 2/1998 | Jo | 123/470 |
| 5,724,946 | A | 3/1998 | Franchitto | |
| 6,382,187 | B1 | 5/2002 | Scollard et al. | |
| 6,418,911 | B1 * | 7/2002 | Augustin | 123/468 |
| 6,491,026 | B1 | 12/2002 | Andorfer | |
| 6,708,672 | B1 * | 3/2004 | Mueller et al. | 123/470 |
| 6,718,949 | B1 * | 4/2004 | Gmelin | 123/470 |
| 6,843,233 | B1 * | 1/2005 | Berger et al. | 123/468 |
| 6,871,634 | B1 * | 3/2005 | Berger et al. | 123/456 |
| 6,874,477 | B1 * | 4/2005 | Lorraine et al. | 123/468 |
| 6,877,484 | B1 * | 4/2005 | Reiter | 123/468 |
| 6,959,695 | B1 * | 11/2005 | Warner et al. | 123/456 |
| 2005/0211225 | A1 * | 9/2005 | Oguma | 123/470 |

* cited by examiner

*Primary Examiner*—Thomas Moulis
(74) *Attorney, Agent, or Firm*—Diana D. Brehob; Bir Law, PLC

(57) ABSTRACT

A fuel system and associated method include a fuel injector and associated injector cup having an integral device that provides rotational orientation while allowing axial sliding engagement of the fuel injector relative to the cup after assembly. One embodiment includes retention tabs in the cup that engage corresponding grooves in the injector.

20 Claims, 2 Drawing Sheets

TWIST-LOCK FUEL INJECTOR ASSEMBLY

FIELD OF THE INVENTION

The present invention relates to components and a process for fuel injector assembly for internal combustion engines.

BACKGROUND ART

Various types of internal combustion engines use a common fuel rail to distribute fuel to individual fuel injectors that inject a specified amount of fuel into corresponding intake ports or directly into the cylinders. A fuel injector cup is typically used to couple the upper end of the fuel injector to the fuel rail, with the lower end of the injector being seated into a corresponding bore in the intake manifold or cylinder head. The injector/cup interface includes an upper (fuel) seal, while the injector/bore interface includes a lower (air) seal. An injector retention/orientation clip may be used to facilitate proper positioning of the fuel injector during assembly (and/or maintenance) and to secure the injector to maintain the upper and lower seals during assembly and operation of the engine. Alternatively, a fuel injector/cup assembly may use a "snap fasten" feature to couple the cup to the fuel injector and eliminate the injector clip. Both methods require relatively tight tolerances for the individual components to assure that the overall tolerance stack-up associated with the fuel rail, cup, fuel injector, clip (where present), and intake manifold/cylinder head is controlled to maintain the integrity of the upper and lower seals during operation of the engine.

SUMMARY OF THE INVENTION

The present invention provides a fuel system and corresponding method of operation that include a fuel injector and associated injector cup having a coupling device that provides rotational orientation while allowing axial sliding engagement of the fuel injector relative to the cup after assembly.

Embodiments of the present invention include a fuel injector and associated cup that include at least one slot and corresponding key to allow axial movement of the injector relative to the injector cup after installation of the injector into the cylinder head or intake manifold to improve tolerancing and stack-up requirements. In one embodiment, the fuel injector includes two axial slots disposed generally across from one another and located above an upper seal of the injector, with the cup having corresponding indentations or keys that engage the slots to limit rotational movement while allowing axial movement of the injector relative to the cup. To facilitate assembly, the axial slot may extend to the top of the injector, which may also include a frustoconical portion. Another embodiment includes a lead-in slot or groove at the top of the injector which connects to a helical or spiral groove, terminating with the axial locking groove to provide a twist and lock assembly motion with the locking groove allowing axial movement between the injector and cup, but limiting rotational movement.

The present invention provides a number of advantages. For example, the present invention allows elimination of any external injector orientation/retention clip and associated assembly steps. The present invention also relaxes tolerance stack-up requirements with respect to the fuel rail, cup, injector, and intake manifold/cylinder head otherwise required to maintain the upper and lower seals. In addition, the present invention may reduce radial or rotational variation of the injector when installed in the cylinder head/intake manifold by eliminating the additional tolerances associated with an injector clip relative to the cup/clip interface and the clip/injector interface.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

Various combinations of features of the present invention are illustrated and described with reference to the Figures. Those of ordinary skill in the art will recognize that the features of the present invention may be used individually, in the combinations illustrated, or in other combinations consistent with the teachings of the invention, although not necessarily explicitly illustrated or described.

Figure 1:
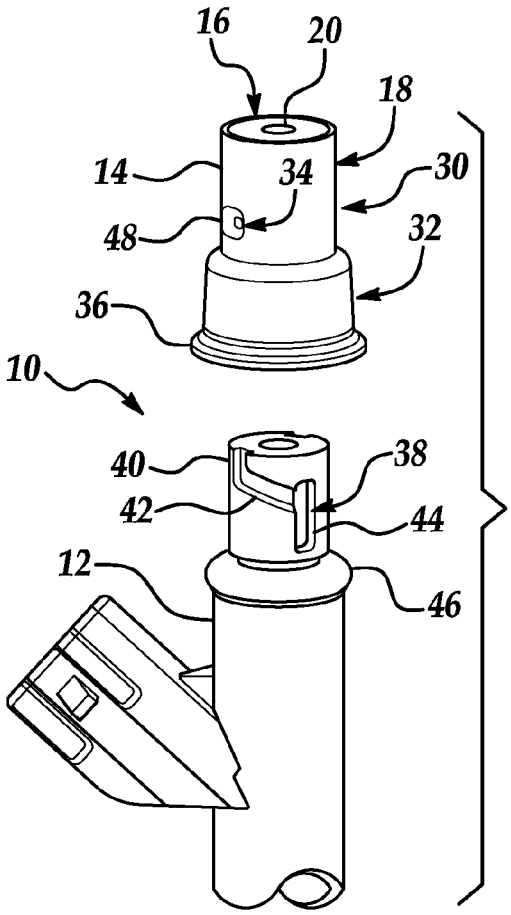
FIG. 1 is a perspective view of a fuel injector and cup according to one embodiment of the present invention.

FIG. 1 is a perspective view of a fuel injector and cup according to one embodiment of the present invention. Fuel system assembly 10 includes a fuel injector 12 and associated fuel injector cup 14. In a typical internal combustion engine application, cup 14 is made of a metallic or plastic material and is fixed to a fuel rail body (not shown) by brazing or a similar operation that joins either top surface 16 or side surface 18 of connecting portion 30 to the fuel rail body. Connecting portion 30 includes a through hole 20 to fluidly couple cup 14 to the fuel rail and deliver fuel to injector 12. In this embodiment, cup 14 includes a sealing portion 32 that includes a flare 36 to facilitate installation of injector 12 into cup 14 without damaging o-ring seal 46, which is generally made of a resilient polymeric material.

As also shown in FIG. 1, assembly 10 includes a coupling device 34, 38 associated with injector 12 and cup 14 to limit rotational movement while allowing axial movement of injector 12 relative to cup 14 after installation of injector 12 into cup 14. In this embodiment, the device is implemented by at least one axial or longitudinal groove or slot 44 in injector 12 and one or more corresponding indentations or keys 48 in cup 14. Preferably, axial slot 44 and key 48 are located above upper o-ring seal 46 to prevent damage to seal 46 during assembly of injector 12 and cup 14, as well as during any subsequent relative axial motion as key 48 slides within axial slot 44.

Those of ordinary skill in the art will recognize that other implementations of a coupling device may include one or more keys implemented by protrusions on the injector and corresponding slots or grooves in the cup. Similarly, for applications having an o-ring seal provided in the cup, the coupling device would preferably be disposed below the seal to avoid damage during assembly/disassembly.

Figure 2:
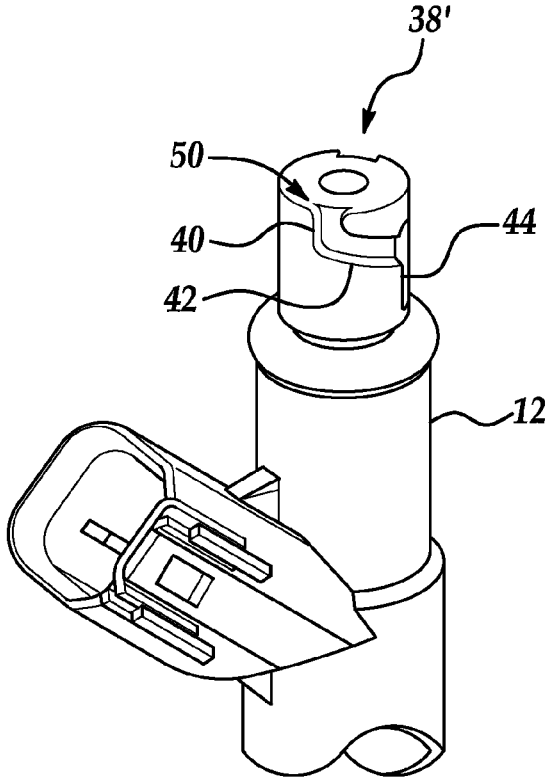
FIG. 2 is an alternative perspective view of the injector and cup of FIG. 1 illustrating the lead-in groove, helical groove, and locking groove of one embodiment of the present invention.

In the embodiment illustrated in FIG. 1, injector device 38 includes a pair of generally diametrically opposed devices 38, 38' (FIGS. 2 and 3) each having a lead-in groove or slot 40 connected to a helical or spiral twist groove or slot 42 that is connected to axial locking groove or slot 44. As best shown in the perspective view of FIG. 2 and top view of FIG. 3, each lead-in groove 40 may include a chamfer 50 to facilitate assembly performed by an operator inserting fuel injector 12 into cup 14 while lining up lead-in grooves 40 with cup device 34, implemented by corresponding diametrically opposed indentations or retention tabs 48 in cup 14 in this embodiment. After retention tabs 48 are engaged with lead-in groove 40, rotation of injector 12 pulls the injector toward cup 14 so that the interior of sealing portion 32 forms a fuel seal with upper o-ring 46.

Figure 3:
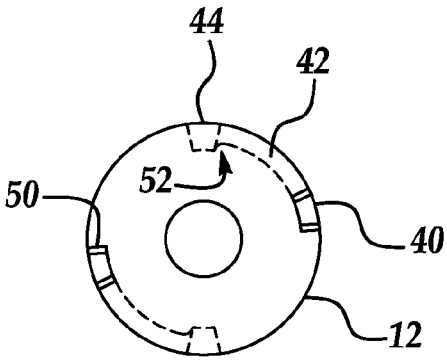
FIG. 3 is a partial top view of an injector illustrating slots or grooves of differing depths according to one embodiment of the present invention.

As shown in the partial top view of injector 12 in FIG. 3, axial locking groove 44 may be deeper than helical groove 42 and lead-in groove 40 to provide a locking feature or device that helps keep tabs 48 within locking groove 44 and deter rotation of injector 12 relative to cup 14 after the retention tabs enter locking groove 44. The transition between helical groove 42 and locking groove 44 may include an appropriate radius 52 to deter rotation during engine operation yet facilitate disassembly of injector 12 from cup 14 when a sufficient rotational force or torque is applied.

Figure 4:
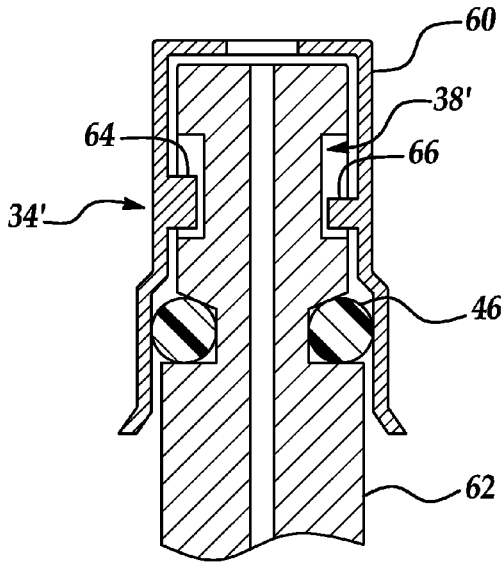
FIG. 4 is a cross-sectional view of the upper portion of an injector and cup assembly according to one embodiment of the present invention.

FIG. 4 is a cross-sectional view of the upper portion of an injector and cup assembly according to one embodiment of the present invention. Cup 60 includes an alternative device 38' that cooperates with a corresponding device 34' of cup 60 to allow axial movement and improve tolerances while limiting rotational movement and providing orientation of injector 62 relative to cup 60. In this embodiment, cup device 34' includes generally diametrically opposed asymmetrical retention tabs 64, 66 which cooperate with correspondingly sized lead-in or helical grooves (FIGS. 1–3) to uniquely orient injector 62 relative to cup 60, i.e. so injector 62 can not be installed 180 degrees out of its intended position. Those of ordinary skill in the art will recognize that various other arrangements may be provided to implement such a feature. For example, the keys and slots may be asymmetrically radially positioned so the injector device and cup device engage in only one rotational position. Alternatively, the width, height, or shape of the retention tabs and corresponding slots may be modified so each tab has a unique slot, etc.

Figure 5:
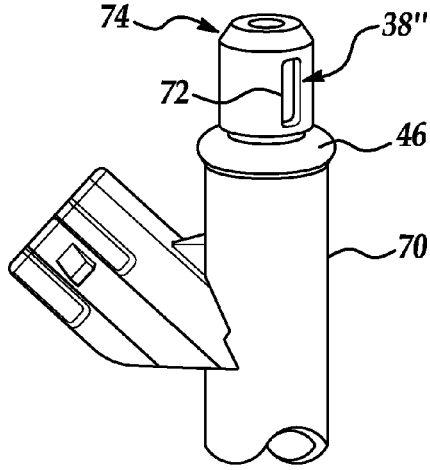
FIG. 5 is a perspective view of an injector having an axial slot and frustoconical top portion according to one embodiment of the present invention.
Figure 6:
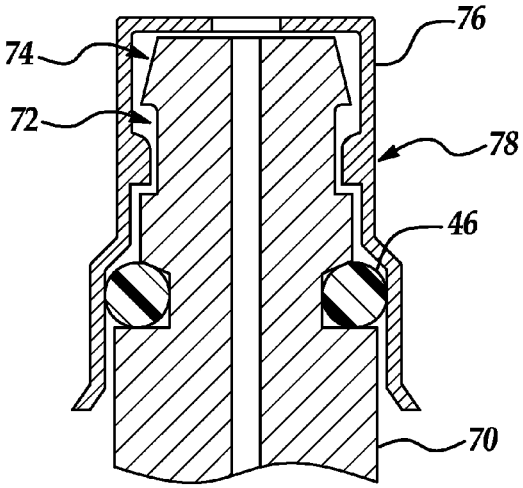
FIG. 6 is a cross-sectional view of an injector and cup assembly for the injector of FIG. 5.

FIGS. 5 and 6 illustrate an injector having an axial slot and frustoconical top portion according to one embodiment of the present invention. In this embodiment, device 38" includes at least one axial slot 72 on the top portion of injector 70 located above upper seal 46. As illustrated, axial slot 72 does not extend to the top surface of injector 70. Top portion of injector 70 terminates in a frustoconical section 74 to facilitate assembly with a corresponding injector cup 76, with retention tabs or indentations 78 that fit within axial groove 72 to provide axial movement while limiting rotational movement after installation. Axial groove 72 and retention tabs 78 may include a rounded upper edge to facilitate disassembly. As with the previously illustrated and described embodiments, locating axial slot 72 above upper seal 46 reduces the possibility of damage to seal 46 by contact with the indentations or retention tabs of a corresponding cup during assembly and/or disassembly.

Figure 7:
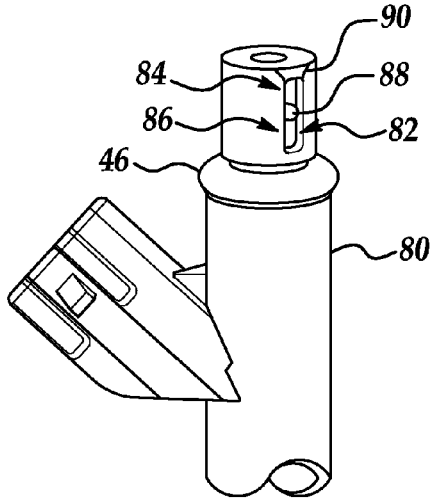
FIG. 7 is a perspective view of an injector illustrating an axial slot or groove according to another embodiment of the present invention.

FIG. 7 is a perspective view of an injector having a device to allow axial movement after installation according to another embodiment of the present invention. In the embodiment of FIG. 7, injector 80 includes a device 82 that provides relative axial movement between injector 80 and a corresponding cup while limiting rotational movement. Device 82 includes a lead-in groove 84 and collinear locking groove 86 separated by a protrusion 88 in the bottom surface of device 82. Protrusion 88 functions to maintain a corresponding retention tab in the locking groove 86 to allow relative axial movement between injector 80 and a corresponding cup after assembly. Lead-in groove or slot 84 includes a chamfer 90 to facilitate assembly.

Assembly of a fuel injector and corresponding cup according to the present invention proceeds by aligning a device associated with the fuel injector with a device associated with the cup and engaging the device(s) until reaching a locking position that allows relative axial movement between the injector and the cup but limits rotational movement between the injector and the cup. In one embodiment, the fuel injector device includes a groove having a lead-in portion, a helical or spiral portion, and an axial locking portion while the cup device includes a key or tab that cooperates with the injector groove. In this embodiment assembly includes rotation of the injector relative to the cup as the key traverses the helical portion drawing the injector toward the cup until the key enters the locking portion. In another embodiment, the assembly process includes aligning a key or indentation on the cup with a corresponding axial groove on the injector and sliding the injector into the cup until the indentation traverses a protrusion or other locking device associated with the groove so that the indentation is retained between the locking device and the distal end of the groove to allow relative axial movement between the injector and cup after assembly.

While the best mode for carrying out the invention has been described in detail, those familiar with the art to which this invention relates will recognize various alternative designs and embodiments for practicing the invention as defined by the following claims.

What is claimed is:

1. A fuel system for an internal combustion engine, the fuel system comprising:

a fuel injector cup for connecting to a fuel rail to distribute fuel; and a fuel injector having one end adapted for insertion into the fuel injector cup, wherein the fuel injector cup and the fuel injector include a coupling device integrally formed in the fuel injector and the fuel injector cup that allows axial movement of the fuel injector relative to the fuel injector cup after the fuel injector and fuel injector cup have been assembled while limiting rotational movement therebetween.

2. The fuel system of claim 1 wherein the coupling device comprises at least one tab on the fuel injector cup and at least one corresponding slot on the fuel injector.

3. The fuel system of claim 1 wherein the coupling device comprises:

generally diametrically opposed indentations on the fuel injector cup; and generally diametrically opposed grooves in the fuel injector.

4. The fuel system of claim 3 wherein each of the grooves in the fuel injector includes a lead-in portion extending to a top surface of the fuel injector, a helical portion, and an axial locking portion.

5. The fuel system of claim 4 wherein the axial locking portion of each groove is deeper than the helical portion.

6. The fuel system of claim 3 wherein each of the grooves in the fuel injector includes an axial lead-in portion extending to a top surface of the fuel injector and an axial locking portion, the lead-in portion and locking portion being separated by a protrusion in a bottom surface of the groove.

7. The fuel system of claim 3 wherein each of the grooves in the fuel injector comprises an axial groove that terminates below a top surface of the fuel injector.

8. The fuel system of claim 3 wherein the fuel injector includes a frustoconical top portion.

9. The fuel system of claim 3 wherein the indentations are asymmetrically shaped.

10. The fuel system of claim 1 further comprising an upper seal positioned to form a fuel tight seal between the fuel injector and the fuel injector cup, wherein the coupling device is disposed closer to a top surface of the fuel injector than the upper seal.

11. A fuel system for a multiple cylinder internal combustion engine, the fuel system comprising:

a fuel injector cup adapted for connecting to a fuel rail for distributing fuel, the fuel injector cup including at least one retention tab extending radially inward; and a fuel injector having a top portion insertable into the fuel injector cup, the top portion including at least one groove that cooperates with the at least one retention tab to limit rotational movement while allowing axial movement between the fuel injector cup and the fuel injector after assembly.

12. The fuel system of claim 11 wherein the at least one groove comprises generally diametrically opposed axial grooves.

13. The fuel system of claim 11 wherein the injector includes opposing grooves having an axial lead-in portion extending to a top surface and a helical portion connecting the lead-in portion to an axial locking portion.

14. The fuel system of claim 13 wherein the axial locking portion is deeper than the helical portion.

15. The fuel system of claim 11 wherein the top portion of the injector includes a frustoconical portion and wherein the at least one groove comprises an axial groove terminating below the frustoconical portion.

16. The fuel system of claim 11 wherein the at least one groove comprises an axial groove extending to a top surface of the fuel injector and includes a lead-in portion and locking portion separated by a protrusion in a bottom surface of the groove.

17. The fuel system of claim 11 wherein the at least one retention tab includes asymmetrically sized opposing retention tabs and wherein the at least one groove includes corresponding asymmetrically sized opposing grooves to uniquely orient the fuel injector within the fuel injector cup.

18. A method comprising:

aligning a coupling device integrally formed in a fuel injector cup with a coupling device integrally formed a fuel injector; and engaging the coupling devices until reaching a locking position that allows relative axial movement but limits rotational movement between the fuel injector cup and the fuel injector.

19. The method of claim 18 wherein the coupling device associated with the fuel injector cup includes opposing indentations and the coupling device associated with the fuel injector includes corresponding opposing axial grooves.

20. The method of claim 18 wherein the step of engaging the coupling devices includes rotating the fuel injector relative to the fuel injector cup.

* * * * *